United States Patent [19]

Mansfeld et al.

[11] 4,411,541

[45] Oct. 25, 1983

[54] RIBBON FEED AND ELEVATING MECHANISM FOR TYPEWRITERS OR SIMILAR MACHINES

[75] Inventors: Manfred Mansfeld, Frankfurt; Karl Wenderoth, Bad Vilbel, both of Fed. Rep. of Germany

[73] Assignee: Triumph-Adler A.G. fur Buro-und Informationstechnik, Nuremberg, Fed. Rep. of Germany

[21] Appl. No.: 343,117

[22] Filed: Jan. 27, 1982

[30] Foreign Application Priority Data

Feb. 13, 1981 [DE] Fed. Rep. of Germany ..... 3105229

[51] Int. Cl.[3] ..... B41J 33/18; B41J 35/14

[52] U.S. Cl. ..... 400/213; 400/216; 400/236.1; 400/697.1

[58] Field of Search ..... 400/697.1, 211, 213, 400/213.1, 216, 216.1, 236.1

[56] References Cited

U.S. PATENT DOCUMENTS 3,397,767 8/1968 Hobbs ..... 400/236.1
3,648,818 3/1972 Scheinpflug ..... 400/216.1
3,841,459 10/1974 Buschmann et al. ..... 400/216.1
4,172,672 10/1979 Oddicini et al. ..... 400/697.1
4,309,118 1/1982 Terashima ..... 400/697.1

FOREIGN PATENT DOCUMENTS 1920010 4/1971 Fed. Rep. of Germany ... 400/697.1

*Primary Examiner*—William Pieprz
*Attorney, Agent, or Firm*—Joseph R. Spalla

[57] ABSTRACT

A ribbon feed and elevating mechanism is so constructed that active parts for incrementally feeding and for elevating a ribbon from a rest position into one or more working positions form one structural unit mounted on a common shaft thereby providing a compact, easy to assemble unit for association with a typewriter of the type having a print element supported on a movable carriage. Due to the interaction of a lifting lever with a control lever and a pivoting lever to which a ribbon guide is linked, it is possible in a simple manner to raise the ribbon alternately into two different reproduction levels. A rocker, arm also mounted on the common shaft, serves to establish the increment of feed by which ribbon is to be advanced.

5 Claims, 5 Drawing Figures

Fig_1
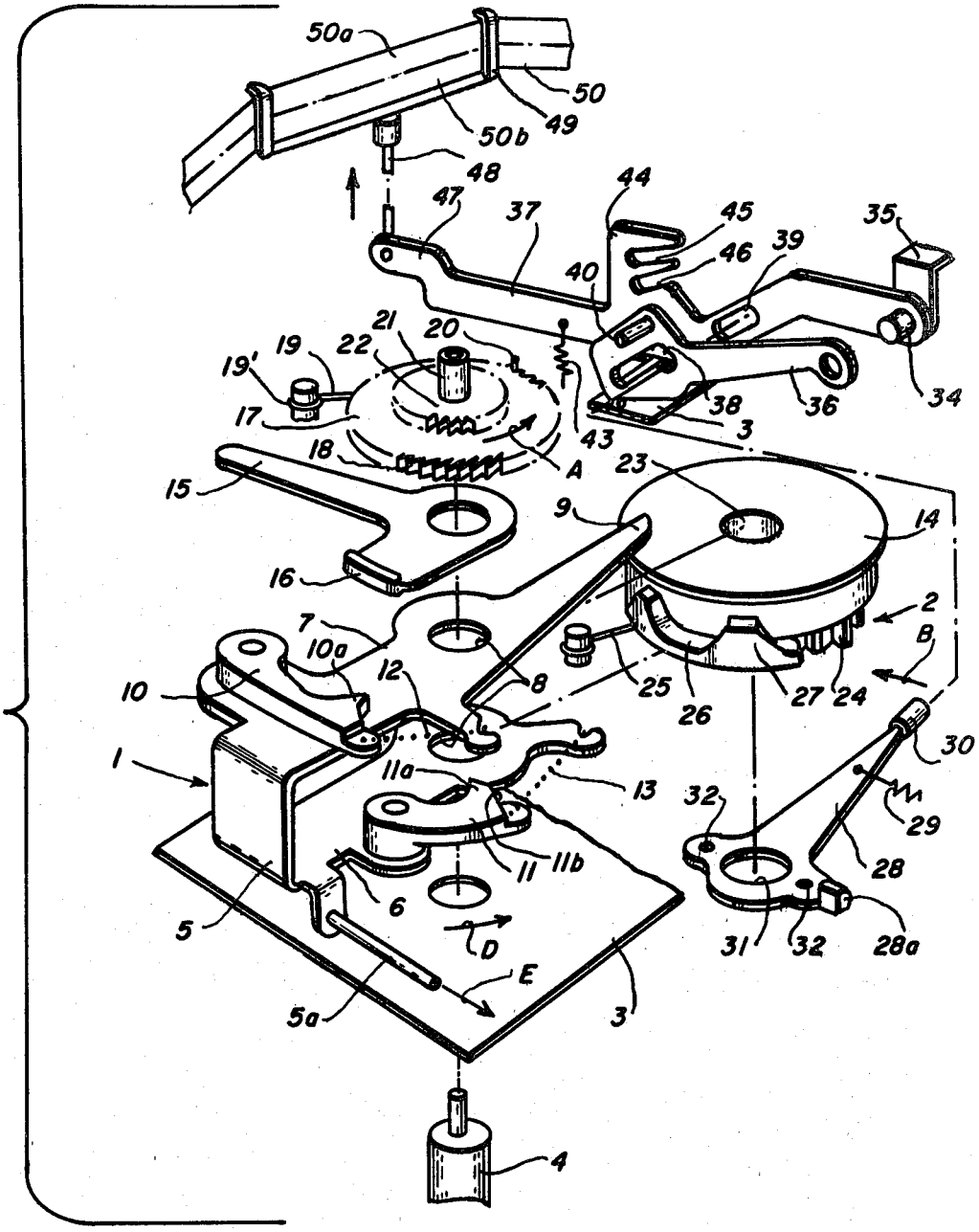
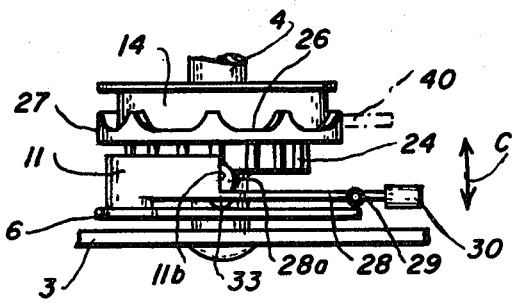
Fig_2

RIBBON FEED AND ELEVATING MECHANISM FOR TYPEWRITERS OR SIMILAR MACHINES

This invention relates to ribbon feed and elevating mechanism for typewriters or similar machines; more particularly it relates to such mechanism having its active elements mounted on a common shaft.

Ribbons or carbon ribbons must be lowered after a character has been typed to clear the view of the typed text. It is necessary, moreover, to advance the ribbon by a certain division to bring a fresh, unused spot into typing position. Carbon ribbons in particular are well utilized in certain machines in that they are acted upon by the type carrier in several levels one above the other. Ribbon feeding and elevating mechanisms to perform the motions required have become known in a multiplicity of designs. For example, DE-PS No. 2 219 312 shows a ribbon transport device. DE-PS No. 2 137 972 shows a ribbon lifting device enabling the ribbon to be raised to several levels relative to the typed line, and after typing, to be lowered far enough to clear the view of the typed text. These devices have worked out well per se. However, a disadvantage of the known devices is that they consist of a considerable number of components which require precision in production and assembly. In addition, these devices require considerable space, making it impossible to use them in small typewriters. The prior art devices also have considerable mass which is unfavorable particularly when the devices are mounted on the type carrier carriage and must be moved stepwise together with it.

In accordance with the invention there is provided an arrangement of parts for feeding and elevating a ribbon which is both compact and easy to assemble, and which is characterized in that active parts are mounted on a common shaft.

An object of the invention is in the provision of a low mass ribbon feeding and elevating mechanism which is compact and easy to assemble.

Another object of the invention is to provide a ribbon feeding and elevating mechanism characterized by an economy of parts and reliable operation and suited for mounting on a movable printing element carriage.

Another object of the invention is to provide a ribbon feeding and elevating mechanism in which the ribbon feed increment can be easily adjusted to match carriage escapement increments to achieve better ribbon utilization.

Other objects, features and advantages of the present invention will become known to those skilled in the art from a reading of the following detailed description when taken in conjunction with the accompanying drawing wherein like reference numerals designate like or corresponding parts throughout the several views thereof, and wherein:

FIG. 1 is an exploded perspective view of the components essential to the invention;

FIG. 2 is a partial side view of the assembly shown in FIG. 1; and

Figure 3:
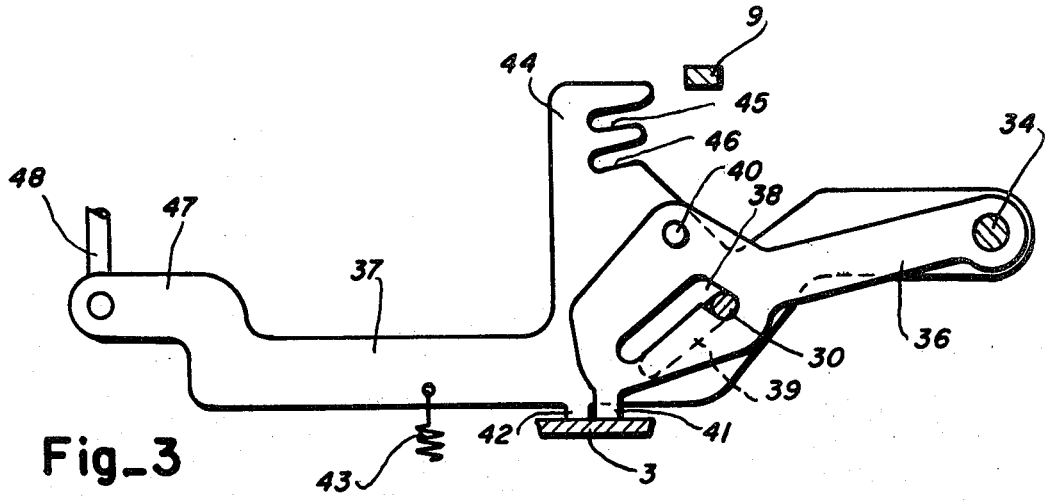
FIGS. 3 to 5 are elevational views showing various positions of the ribbon elevating parts.

Referring now to the drawing there is shown in FIG. 1 a ribbon feed subassembly generally designated by reference numeral 1 and a ribbon elevating subassembly generally designated by reference numeral 2. A plate 3 which serves to support the ribbon feed and elevating mechanisms may form part of a housing mounted to a type carrier carriage. Plate 3 supports a shaft 4 on which all essential components of the assemblies can be mounted. Supported on the shaft 4 is a pivoting yoke 5 with its two horizontally extending legs 6 and 7, each having bearing bores 8. Leg 7 is extended in a manner resulting in an blade 9 which as will hereinafter be explained establishes the limit of ribbon elevation. Mounted to each leg 6 and 7 is a pawl 10, 11, respectively, loaded by springs 12 and 13. The springs 12 and 13 are indicated only by a series of dots to avoid cluttering the Figure. Pawl 10 is the drive for the ribbon feed subassembly 1 and pawl 11 is the drive for the ribbon elevating subassembly 2.

When assembling the pivoting yoke 5 to the shaft 4, a ribbon elevate control wheel 14 is inserted between the legs 6 and 7 so that it is located between them in the assembled state. Above the leg 7, a rocker arm 15 with a shield 16 is mounted on the shaft 4 and above the rocker arm 15 the shaft 4 supports a ribbon feed ratchet 17, the teeth 18 of which interact with the pawl 10. The ratchet 17 is detentably held as by a spring 19 anchored at one end as at 19' and having its free end 20 bent up to engage ratchet teeth 18 to prevent an unintentional rotation of the feed ratchet 17 opposite to the arrow direction A.

The hub 21 of the transport wheel 17 can be formed to directly engage in known manner a ribbon spool driver (not shown), in a ribbon cassette placed on top of it, or a gear 22 on the feed ratchet for driving a complementary gear in the cassette (not shown), may be employed. In certain typerwriters capable of accepting different ribbon types, both above mentioned drives may also be provided.

With reference to FIGS. 1 and 2 the ribbon elevate control wheel 14 has a bearing bore 23, by means of which it is rotatably mounted on the shaft 4 between legs 6 and 7, the ribbon elevate control wheel is formed with a ratchet 24 which is drivingly engageable by pawl 11, as will yet be described. As with the ribbon feed ratchet 17, a detent spring 25 engages the teeth of ratchet 24 to prevent unintentional rotation of the ribbon elevate control wheel 14. A vertical lift ring 26 from the upper surface of which cams 27, spaced predetermined distances apart, extend axially upward, is provided on the periphery of the ribbon elevate control wheel 14.

Also mounted on the shaft 4 between the ribbon elevate control wheel 14 and the lower leg 6 of the pivoting yoke 5 is a primary lifting lever 28 which is loaded by a spring 29 tending to pull the lifting lever 28 opposite to arrow direction B. At its free end, the lifting lever 28 ends in a bolt 30. The lifting lever 28 is also adapted to be tiltable transverse to its vertical, longitudinal axis as by providing clearance between the shaft 4 and its bearing bore 31. Located lateral to the bearing bore 31 are depressions 32 forming depending protrusions 33 which support the lifting lever 28, as is evident particularly from FIG. 2, on the lower leg 6 of the pivoting yoke 5. This is to enable the lever 28, as may also be seen from FIG. 2, to pivot in the direction of the double arrow C.

With particular reference again to FIG. 1 there is mounted to a trunnion 34 attached to a part 35 extending from the plate 3 an elevate control lever 36 and a pivoting ribbon elevate lever 37. The control lever 36 has an angular slot 38 whereas the pivoting lever 37 has a straight slot 39. In addition, a rod 40 extending from the control lever 36 extends toward and within the periphery of the ribbon lift ring 26 of the lift control wheel 14 for interacting with the upper surface of the ring 26 and the cam 27 rising therefrom as will yet be described. At its lower edge, the control lever 36 is supported by the plate 3. As shown FIGS. 3 and 4, the lower edge of the control lever 36 may be provided with a boss 41 for this purpose. A similar boss 42 is provided on the pivoting lever 37 which is loaded by a spring 43. The pivoting lever 37 has a tab 44 with two notches 45 and 46. The free end 47 of the pivoting lever 37 is connected to a rod 48 which supports the ribbon guide 49 through which ribbon 50 is guided.

In assembled condition ribbon feed pawl 10 is ready to interact with ribbon feed ratchet 17. In the position at rest the pawl tooth 10*a* is in contact with the shield 16 of the rocker arm 15. Depending on the set position of the rocker arm 15 the pawl tooth 10*a* of the pawl 10 can, upon a pivoting motion of the pivoting yoke 5 in direction of arrow D, slide off the shield 16 sooner or later and engage the teeth 18 of the ribbon feed ratchet 17 earlier or later in its stroke, thereby to adjust the increment by which the ribbon 50 is to be moved. When the pivoting yoke 5 returns into its rest position, the pawl tooth 10*a* disengages from the teeth 18 of the transport wheel 17 and contacts the shield 16 again, and the detent spring 19 and its hookshaped end 20 prevents the pawl 10 from unintentionally driving the ratchet 17 opposite to the rotary direction of arrow A. As already mentioned the rotary motion of the ribbon feed ratchet 17 may be transmitted to the drive mechanism in a ribbon cassette either by a driver on the hub 21 or by the gear 22.

The motion of the pivoting yoke 5 may be initiated, for instance, as by a magnet (not shown) or by a cam drive. This is indicated in the drawing merely by a pull rod 5*a*, the working pull of which is in the direction of arrow E.

The pawl tooth 11*a* of the ribbon elevate pawl 11 is in engagement with the ratchet 24 of the ribbon elevate control wheel 14 to rotate it a predetermined rotary increment when the pivoting yoke 5 performs a pivoting motion in direction of arrow D. When the pawl 11 returns, the detent spring 25 prevents the lift control wheel 14 from being turned in the wrong direction unintentionally.

The pivoting motion of the pawl 11 is also utilized to pivot the lifting lever 28 in arrow direction B. For this purpose the lever 28 is also formed with an upward protrusion 28*a*, against which the face 11*b* of pawl 11 rests. When the device is in rest position, the spring 29 causes the protrusion 28*a* of the lifting lever 28 to rest against the face 11*b* of pawl 11. Accordingly, the pawl 11 serves as stop for the lifting lever 28. This feature is made clear in FIG. 2

As indicated in FIG. 1 and FIGS. 3–5 the bolt 30 of the lifting lever 28 penetrates both slots 38 and 39 of the elevate control lever 36 and pivoting ribbon elevate lever 37, respectively. This means that a pivoting motion of the lifting lever 28 is transferred to the control lever 36 and the pivoting lever 37 in a manner yet to be described.

With particular reference now to FIGS. 3 the rest positions of the bolt 30 of the lifting lever 28, the control lever 36 and the pivoting lever 37 are shown wherein the spring 43 causes the control lever 36 and the pivoting lever 37 to be supported by the plate 3 by means of their bosses 41, 42, respectively. In this rest position the ribbon guide 49 with the ribbon 50 assumes a lowered or rest position so that the view of the typed line is clear.

Upon a pivoting motion of the pivoting yoke 5 about the shaft 4 both the lifting lever 28 and the ribbon elevate control wheel 14 are rotated in arrow direction B. With reference to FIG. 3 this movement causes the bolt 30 of the lifting lever to move in arrow direction F from its FIG. 3 position to the position shown in FIG. 4 where it reaches the highest point in the knee of the slot 38. At the same time, the bolt 30 drives the pivoting lever 37 by means of slot 39 so that the pivoting lever 37 arrives in the raised position shown FIG. 4. This is made possible in that the control lever 36 supports itself against the plate 3. Thus, the short angular end of slot 38 in the control lever 36 acts as a sliding track for the bolt 30. In the FIG. 4 position the ribbon 50 is raised so far by the ribbon guide 49 that the level 50*a* reaches the level of the printing line. The arrangement and the functions described so far would suffice for a ribbon 50 typed on in one level only, enabling the lift control wheel 14 and the rod 40 on the control lever 36 to be omitted.

However, the disclosed embodiment also permits raising the ribbon 50 so far that level 50*b* reaches the level of the printing line. The manner by which this is accomplished will now be described.

As hereinbefore noted the rod 40 of the control lever 36 extends into the periphery of the lift ring 26 on the lift control wheel 14 and engages either the upper surface of ring 26 or the upper surface of cam 27 of the control wheel 14. With reference to FIG. 1, assuming rod 40 is positioned in contact with the surface of ring 26 directly to the left of a foot of a cam 27, and the pivoting yoke 5 is cycled when the rod 40 is so positioned, the lift control wheel 14 is thereby rotated by means of the pawl 11 and the rod 40 slides along surface of ring 26 to the foot of the next following cam 27. Thus during the simultaneous pivoting motion of the lifting lever 28, the pivoting lever 37 with the ribbon guide 49 is brought into the position shown in FIG. 4, as described above without effect by the control wheel. Upon the return of the pivoting yoke 5 into its basic position, the bolt 30 of the lifting lever 28 is returned by the spring 29 into the position corresponding to FIG. 3. During the next operating motion of the pivoting yoke 5 the lift control wheel 14 is rotated again by the pawl 11. In this process, the bolt 30 of the lifting lever 28 travels in arrow direction F as described above. But since the lift control wheel 14 also advances, the rod 40 of the control lever 36 follows the rise of one of the cams 27. This means that the bolt 30 of the lifting lever performs a motion corresponding to arrow G in FIG. 5. When the bolt 30 of the lifting lever 28 has reached the position corresponding to FIG. 4, the level 50*a* of the ribbon 50 arrives at the level of the print line again for the time being. But due to the additional motion of the bolt 30, the control lever 36 is raised also, so that latter's boss 41 disengages from the plate 3. This triggers a lifting motion of the ribbon guide 49 by means of the pivoting lever 37, the stroke being such that the level 50*b* of the ribbon 50 arrives at the level of the print line. As the lift control wheel 14 continues to rotate, the rod 40 rides down from the upper surface of one of the cams 27 again and rests on the ring 26. At the same time, the bolt 30 of the lifting lever 28 slips into the angular portion of the slot 38 in the control lever 36 again, thereby returning the pivoting lever 37 into its rest position. Raising the ribbon guide 49 is accomplished by the alternating interaction of the rod 40 on the control lever 36 with the ring 26 and the cams 27, alternating between the level or tracks 50*a* and 50*b* of the ribbon 50 in a zig zag or saw tooth fashion. When a ribbon e.g. a carbon ribbon is employed with zig zag ribbon elevation the rocker arm 15 may be positioned to effect shorter ribbon feed increments.

To prevent the ribbon 50 overshooting its stroke, the blade 9 lockingly engages one of the notches 45 or 46 on the pivoting lever 37. In rest position, the arm 9 is in the position shown in FIG. 3. Consequently, during its pivoting motion in arrow direction B (according to the pivoting motion of the lifting lever 28 in FIG. 1) the arm 9 travels into the notch 45, thereby preventing an uncontrolled continuation of the pivoting motion of the pivoting lever 37. The same happens when the pivoting lever was swung up into the second lifted position. Then, however, the arm 9 engages the notch 46 and locks the pivoting lever 37 in that position. Only after the arm 9 has left one of the notches 45 or 46 can the spring 46 return either the pivoting lever 37 alone or, with the cooperation of the bolt 30 on the lifting lever 28 and of the slots 38 and 39, also the control lever 36 into their rest position again.

Figure 4:
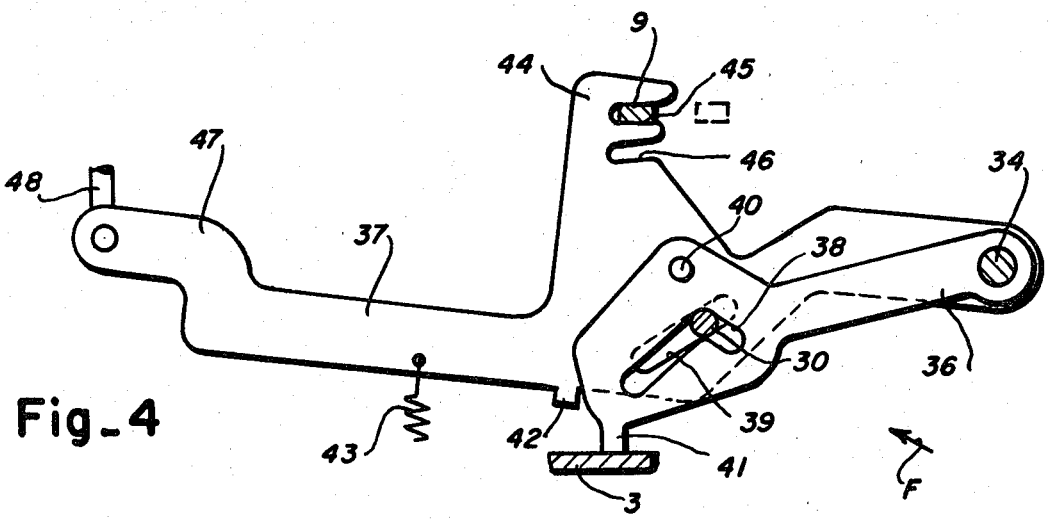
Figure 5:
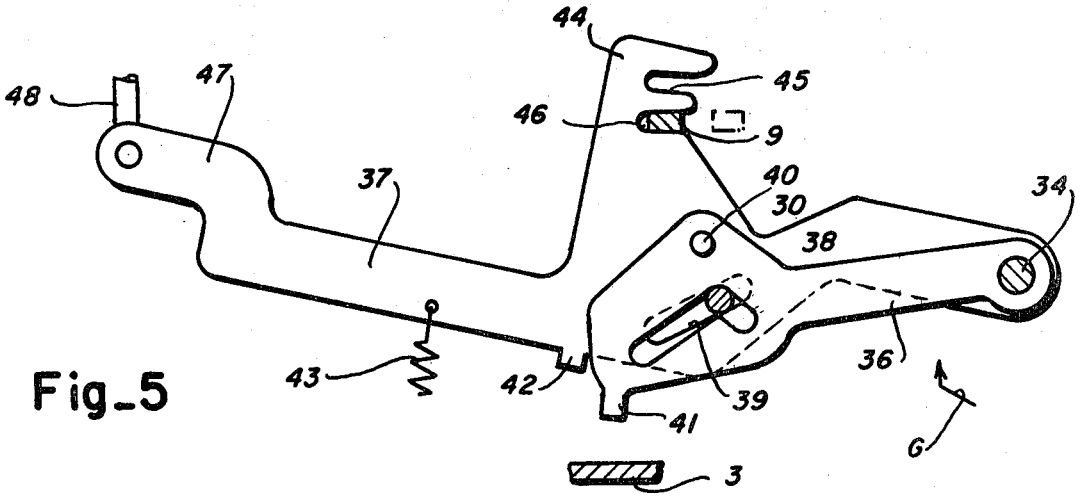

The protrusions 33 of the lifting lever 28 enable the latter to tilt upwardly as required to arrive in the position according to FIG. 5 from the position in FIG. 4.

Tests have proved that a significant part of the components can be made of plastic. This results not only in cheaply produced components, but also in a reduction of the masses to be moved. For instance, the transport wheel 17 together with the gear 22, the pawls 10 and 11 and particularly the lift control wheel 14 can be made of plastic.

The invention claimed is:

1. In a typewriter or like machine having a support frame, a shaft supported on said frame, lever means rotatably mounted on said shaft for cyclic movement from a rest position to an active position and return to rest position to effect ribbon feed and elevating, a ribbon feed ratchet mounted on said shaft adapted to be coupled to rotatably drive a ribbon spool, said lever means including a first pawl for engaging and driving said ribbon feed ratchet incident to cyclic movement of said lever means, a pivoting lever mounted on said frame and operative to elevate ribbon supported thereby.

a ribbon lift lever rotatably mounted on said shaft coupled to pivot said pivoting lever incident to a cyclic motion of said lever means, said lever means including a second pawl for driving said ribbon lift lever, and a control lever pivotally mounted on said frame and coupled to said ribbon lift lever for controlling the movement of said ribbon lift lever imparted to said pivoting lever.

2. In a typewriter as recited in claim 1, further including adjustable means rotatably mounted on said shaft to control the timer of engagement of said first pawl with said ribbon feed ratchet.

3. In a typewriter as recited in claim 1, said pivoting lever and said control lever couplings to said ribbon lift lever comprising slots in said pivoting and control levers, and a bolt on said ribbon lift lever extending into said slots thereby to control said ribbon lift lever motion imparted to said pivoting lever.

4. In a typewriter as recited in claim 3, further including a lift control wheel rotatably mounted on said shaft, said lift control wheel having a cam ring and an index ratchet, said second pawl being engageable with said index ratchet for indexing said control wheel incident to a cyclic motion of said lever means, said cam ring defining alternating low and high surfaces, and a rod extending from said control lever and engaging said cam ring for pivoting said control lever when said rod is lifted by said high surfaces, thereby to modify the motion imparted to said pivoting lever by said ribbon lift lever to effect ribbon elevation to a higher level.

5. In a typewriter as recited in claim 4, said pivoting lever having first and second notches, and said lever means including a blade for engaging one or the other of said notches to mementarily lock said pivoting lever at an elevated position.

* * * * *